United States Patent [19]

Okada

[11] Patent Number: 5,074,559

[45] Date of Patent: Dec. 24, 1991

[54] SLOT MACHINE

[75] Inventor: Kazuo Okada, Tochigi, Japan

[73] Assignee: Kabushiki Kaisha Universal, Oyama, Japan

[21] Appl. No.: 502,877

[22] Filed: Apr. 2, 1990

[30] Foreign Application Priority Data

Apr. 3, 1989 [JP] Japan ..... 01-84549

[51] Int. Cl.[5] ..... A63F 5/04

[52] U.S. Cl. ..... 273/143 R; 273/138 A

[58] Field of Search ..... 273/143 R, 138 A; 364/410, 411, 412

[56] References Cited

U.S. PATENT DOCUMENTS 4,573,681 3/1986 Okada ..... 364/412
4,772,023 9/1988 Okada ..... 273/143 R
4,773,647 9/1988 Okada et al. ..... 273/143 R

FOREIGN PATENT DOCUMENTS 0282631 9/1988 European Pat. Off. ..... 273/138 A

*Primary Examiner*—Edward M. Coven
*Assistant Examiner*—Jessica J. Harrison
*Attorney, Agent, or Firm*—Young & Thompson

[57] ABSTRACT

A slot machine has a memory in which first judgment data and second judgment data are stored. These first judgment data show for any first random number, whether any one of a group of prize-winning symbols can be selected, and the second judgment data show, for any second random number, the particular prize-winning combination to be displayed. A judgment is thus performed twice, using random numbers sequentially sampled from a random number generator, using the first and second data. According to the result of these two judgments, the stopped position of each reel is controlled such that the symbol combination of this specific winning combination will be displayed.

13 Claims, 7 Drawing Sheets

SLOT MACHINE

BACKGROUND OF THE INVENTION

This invention relates to a slot machine and more particularly to a slot machine of the type which determines the occurrence of specific hits by the use of random numbers.

In conventional slot machines, the combination of symbols to be displayed on a ;;inning line when the reels stop is decided by a selected random number value. In order to determine the symbol combination, a single body of judgment data is used in which the relation between the kinds of hit and a random number is memorized. Upon reference to the judgment data, a determination is made as to whether or not the random number from a random number generator corresponds to a prize-winning hit, and if it does, what kind of hit it is. Based on such a judgment, a stopped position for each reel is determined in such a manner that either a losing symbol combination or a winning symbol combination is displayed.

In the above-described conventional slot machine, there is the possibility that a specific hit paying a comparatively large dividend can occur twice in succession because the win control is effected according to probability. For instance, in a three-reel type of machine, let it be assumed for example that a combination of two winning symbols of "7" successively aligned on one winning line denotes a middle hit (or a middle win) and that a combination of three winning symbols of "7" aligned on one winning line denotes a big hit (or a big win). If such specific hits paying a comparatively large dividend have appeared in the early part of the probability cycle (the total of times of playing the game required for generating all the hits and losses in accordance with probability), the frequency of generation of specific hits becomes considerably less in the course of the remaining games of the cycle. On the contrary, if such specific hits appear in the later part of the probability cycle, a large number of lost games would be required until such specific hits appear. However, in a slot machine in which such specific hits occur in such an undistributed manner, the player seldom has the patience for playing further. As a result, players may show little interest in that machine. Of course, the same is true even in the case where there are only two kinds of hit symbol combinations, i.e., "77" and "777".

OBJECTS OF THE INVENTION

It is therefore a principal object of the present invention to provide a slot machine capable of keeping the interest of the players for a long period of time.

Another object of the invention is to provide a slot machine capable of generating hits with a generally constant frequency.

SUMMARY OF THE INVENTION

In order to achieve the above and other objects and advantages, in a slot machine of the present invention a memory and a control means are provided, said memory being adapted to store therein first judgment data used in a first judgment which determines the relation between a random number from random number generating means by a first trial, thereby to determine whether a hit group selection can be made. Second judgment data are used to make a second judgment of the relation between a random number from a second trial and the kind of hit within the hit group. The control means is adapted to control the stopped position of each reel such that, when the result of the first judgment reveals that a hit group selection can be made, a second judgment is made to decide the kind of hit included in the group which is to occur, and to stop the reels in a position to display the selected kind of it.

In another embodiment of the present invention, the stopped position of each reel is controlled such that the kind of hits in a group is determined by a first judgment and such that, only when it is decided by the second judgment that the group selection can be made, a symbol combination in correspondence with the kind of hit decided on by the first judgment is achieved.

According to the present invention, as judgment is made twice, using two kinds of data, in order to determine whether a hit group selection can be made and to determine the kind of hits included in the group, the probability cycle proceeds in a more uniform way, and the generation of a specific hit is better distributed, that is, not bunched or lopsided. Therefore, in the slot machine of the present invention, it is possible to encourage the players to play the machine for a long period of time and yet it is possible to generate specific hits at the same probability as when using the conventional single judgment.

BRIEF DESCRIPTION OF THE DRAWINGS

Other objects and advantages of the present invention will become manifest from the following detailed description of the present invention with reference to the accompanying drawings, wherein.

DETAILED DESCRIPTION OF THE INVENTION

Figure 1:
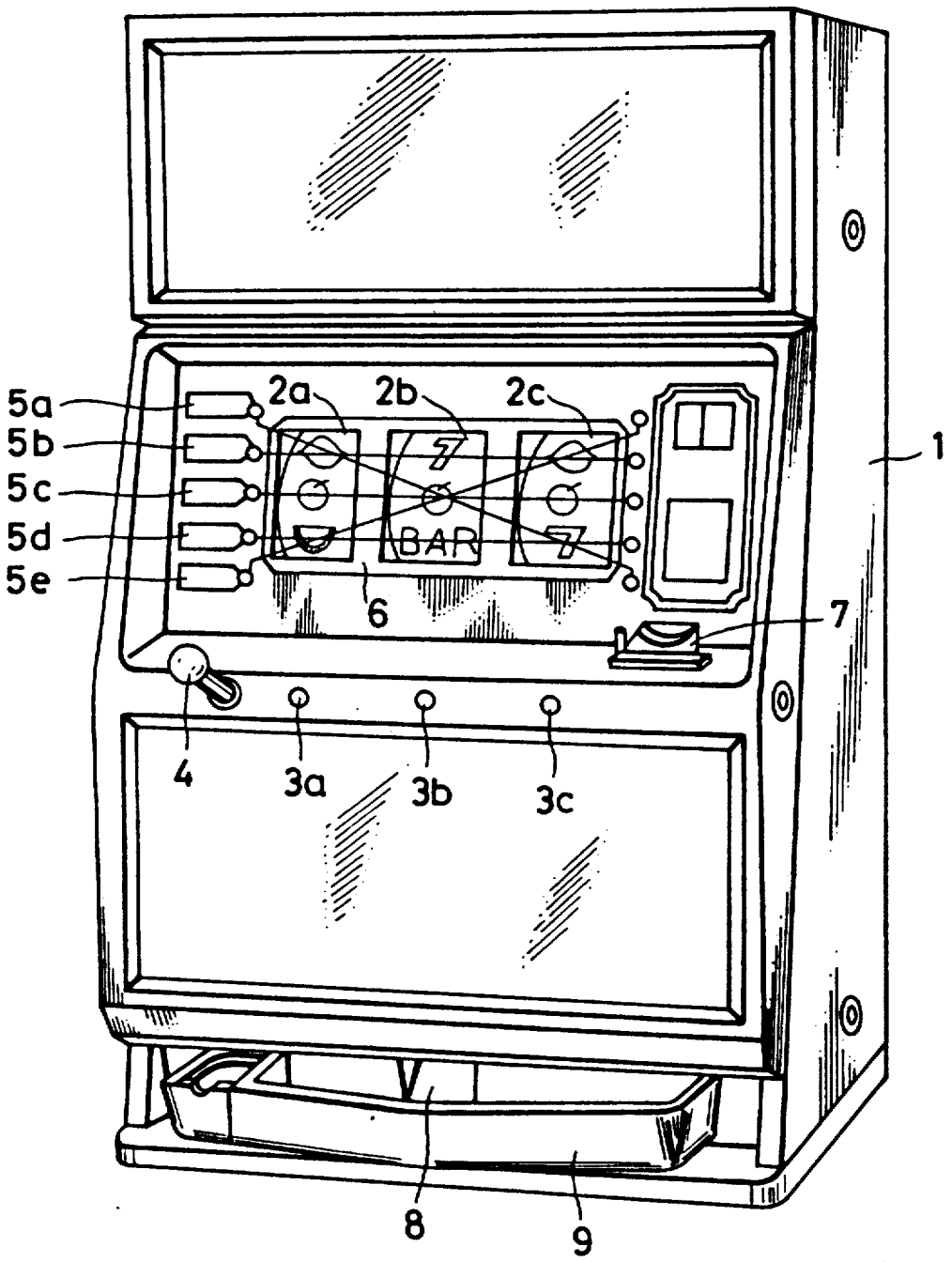
FIG. 1 is a perspective view slowing the outer appearance of a slot machine of the present invention.

In FIG. 1 showing a slot machine of the present invention, a housing 1 contains a first reel 2*a*, a second reel 2*b* and a third reel 2*c*. These reels 2*a* through 2*c* are simultaneously rotated upon actuation of a start lever 4. The rotating reels 2*a* through 2*c* are stopped when the corresponding stop buttons 3*a*, 3*b* and 3*c* are actuated. Among the plurality of symbol marks depicted on the outer surfaces of the stopped reels 2*a* through 2*c*, three symbols on each reel can be observed through a window 6. The housing 1 is provided with a coin insertion slot 7 into which a coin is inserted, a coin hopper 8 for paying out coins when a "hit" has been generated, the number of the coins to pay out being in correspondence with the kind of the hit, and a coin saucer 9 for receiving such paid-out coins. The window 6 displays a plurality of winning lines 5*a* through 5*e*, and the number of effective winning lines is increased in accordance with an increase in the number of coins inserted.

Figure 2:
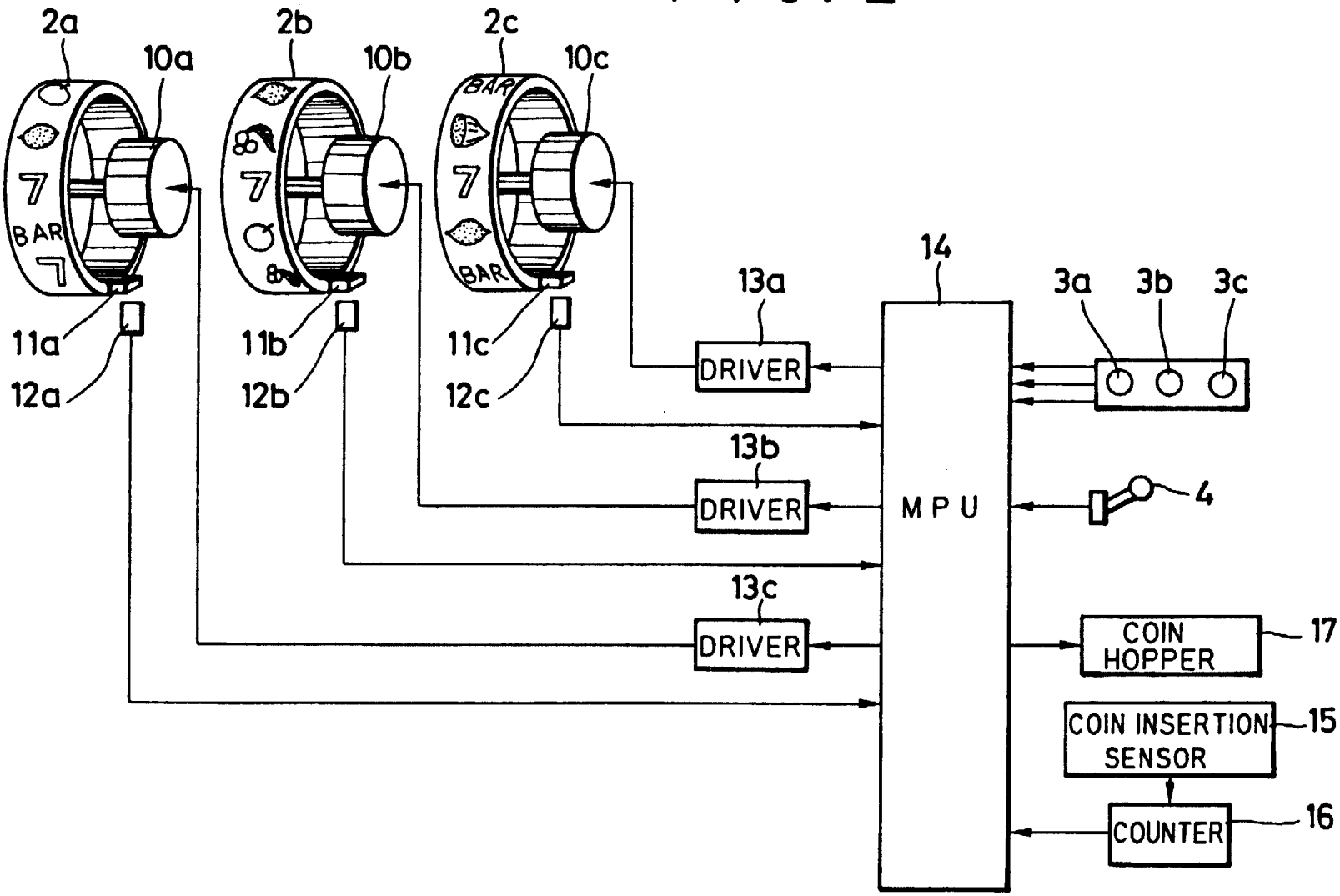
FIG. 2 is a block diagram of a driver circuit for actuating the respective reels.

In FIG. 2 showing the driver circuit of the slot machine, pulse motors 10*a* through 10*c* are provided for driving the first reel 2a, the second reel 2b and the third reel 2c respectively. The respective reels 2a through 2c are provided with light-shielding pieces or tongues 11a, 11b and 11c showing base or start positions of the reels 2a through 2c. Sensors 12a, 12b, and 12c generate a detection signal, respectively, when they detect passage of the tongues 11a through 11c and transmit the signal to an MPU 14. The detection signals are used for determining rotational positions of the respective reels 2a through 2c.

A microswitch, for example, is used as a coin insertion sensor 15 and adapted to detect inserted coins. This detection signal is transferred to a counter 16 in which the number of the coins inserted is counted. When one game is over, the counter 16 is reset. The MPU 14 connected to the counter 16 makes the winning line 5c effective when the number of inserted coin is one, and the winning lines 5b, 5c and 5d effective when the number of inserted coin is two. Similarly, the MPU 14 makes all winning lines 5a through 5e effective when three coins have been inserted. When the start lever 4 is pulled down, the MPU 14 initiates the rotation of the reels 2a through 2c simultaneously. When the respective buttons 3a through 3c are actuated, the MPU 14 stops the reels 2a through 2c individually in accordance with the timing of actuation. In case a symbol combination aligned on the effective winning line is a prize winning symbol combination, a coin hopper 17 pays out the number of coins in correspondence with the rank of such a hit.

Figure 3:
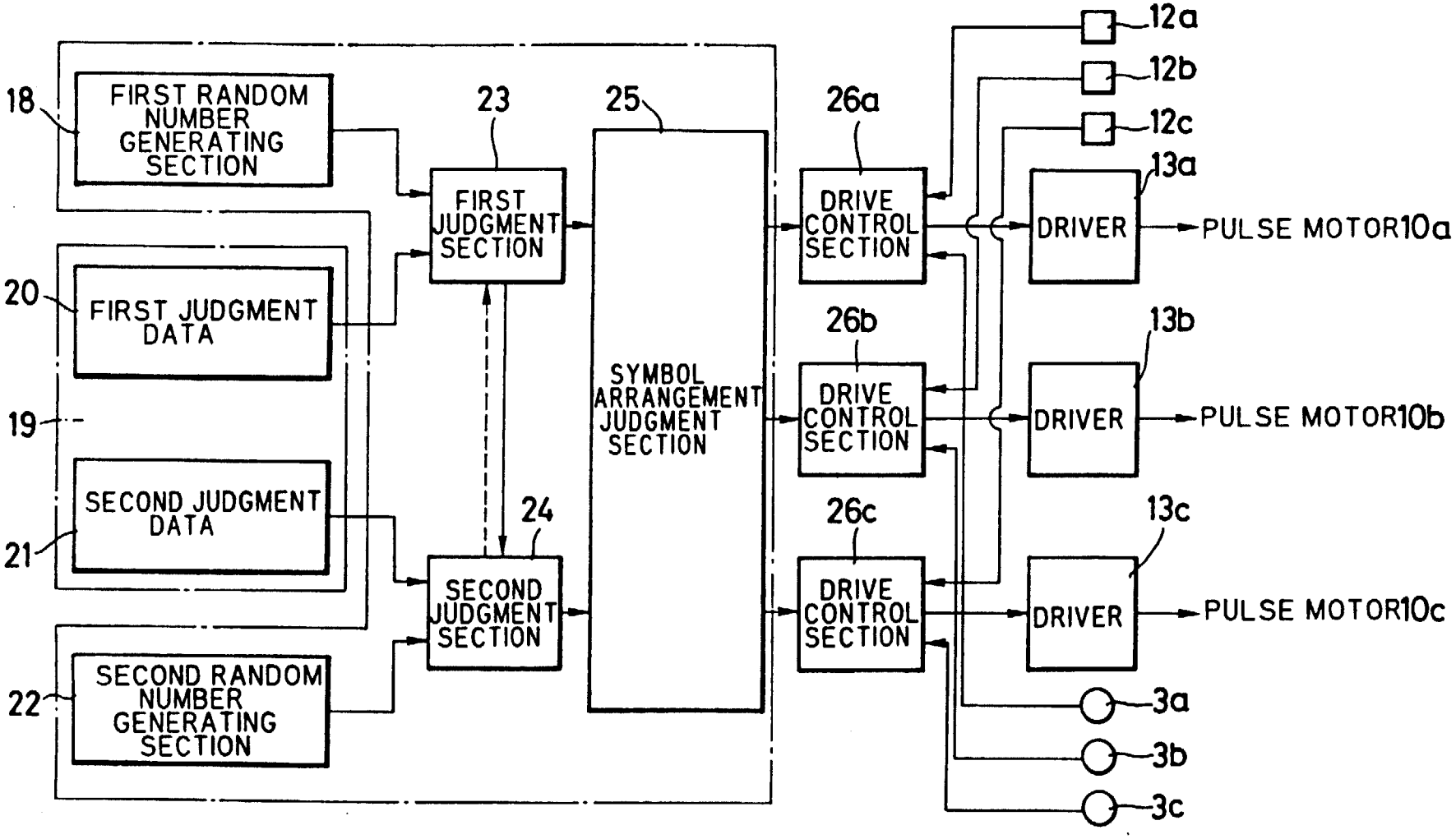
FIG. 3 is a block diagram of the function of a microprocessor unit (hereinafter simply called MPU)
Figure 4:
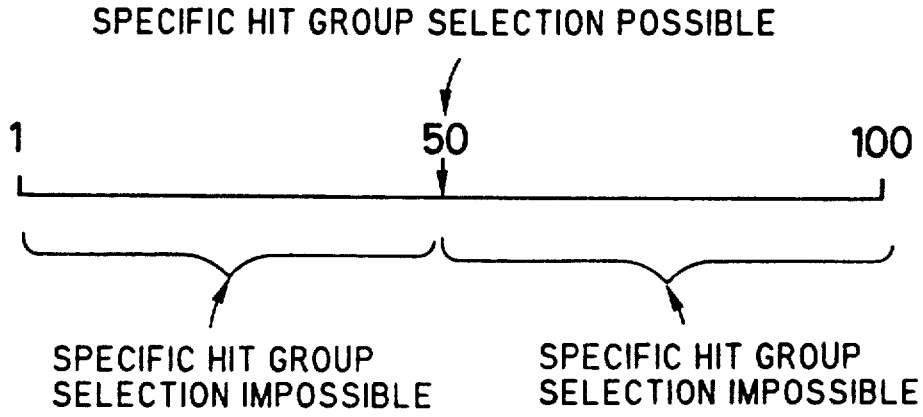
FIGS. 4 and 5 are explanatory views showing judgment data.
Figure 5:
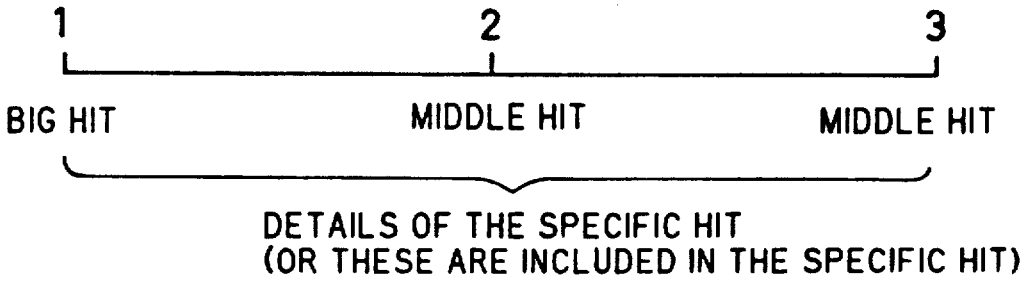

In FIG. 3, first judgment data 20 as schematically shown in FIG. 4 and second judgment data 21 as schematically shown in FIG. 5 are stored in a memory 19. The first judgment data 20 show the relation between, on the one hand, whether a specific hit group can be selected or not, and on the other hand a random number, and comprise a probability table for deciding whether such specific hit group is to be selected. In this embodiment, the numeric symbol "7" is the hit symbol and the symbol combination "777" is a big hit for which the largest number of coins is paid out. A symbol combination "77" is a middle hit for which a medium number of coins is paid out. Such a big hit and middle hit are included in the specific group. In case only one hit symbol "7" is in a symbol combination, it means a loss. In this way, when another hit symbol "7" on an adjacent reel happens to be stopped immediately before the effective winning line, it can cause the player to have a feeling of having only just missed a win, which maintains the player's interest in the game. The second judgment data 21 show the relation between the kind of specific hits, and a random number, and comprise a probability table for generating a specific hit. In this embodiment, the big hit "777" and the middle hit "77" appear with a probability of $\frac{1}{8}$ and $\frac{1}{3}$, respectively.

The first judgment section 23 judges whether a random number taken from a first random number generating section 18 shows that a specific hit group can be selected with reference to the first judgment data 20. In case the first judgment reveals that a specific hit group can be selected, there is performed a second judgment using a random number taken from a second random number generating section 2 and using the second judgment data 21, and a decision is made as to a hit symbol combination included in a specific hit group. In accordance with results of the judgments made by the first and second judgment sections 23 and 24, a symbol arrangement judgment section 25 determines the respective symbols to be displayed when the respective reels 2a through 2c stop and transmits the corresponding signals to respective drive control sections 26a, 26b and 26c. These drive control sections 26a through 26c control the stopped position of each of the pulse motors 10a through 10c through drivers 13a, 13b and 13c such that the selected symbols will appear. Because the numbers of driving pulses from the base: or start positions of the respective reels 2a through 2c correspond to the positions of the respective symbols, the drive control sections 26a through 26c can control the stopped positions of the respective symbols by counting the driving pulses supplied to the pulse motors 10a through 10c. The MPU 14 can be a conventional microcomputer.

In the above-described embodiment, whether a particular hit group can be selected or not is judged by the first judgment, and the kind of the specific hit is judged by the second judgment. However., this may be performed in the reverse order. That is, the first judgment can be made using the second judgment data 21 and then the second judgment can be made using the first judgment data 20. And in case the second judgment reveals that the specific hit group can be selected, the stopped position of each of the reels 2a through 2c is controlled such that the specific hit decided upon by the first judgment will be accomplished.

As will be apparent from the foregoing, since the probability cycle proceeds in a more uniform way by using two kinds of judgment data, it becomes possible to generate a specific hit at least once in a hundred games, for example. In this way, the frequency of generating a specific hit can be made constant. By contrast, heretofore, as the probability cycle is about 8000 games, the frequency of generating a specific hit has tended to be lopsided.

Figure 6A:
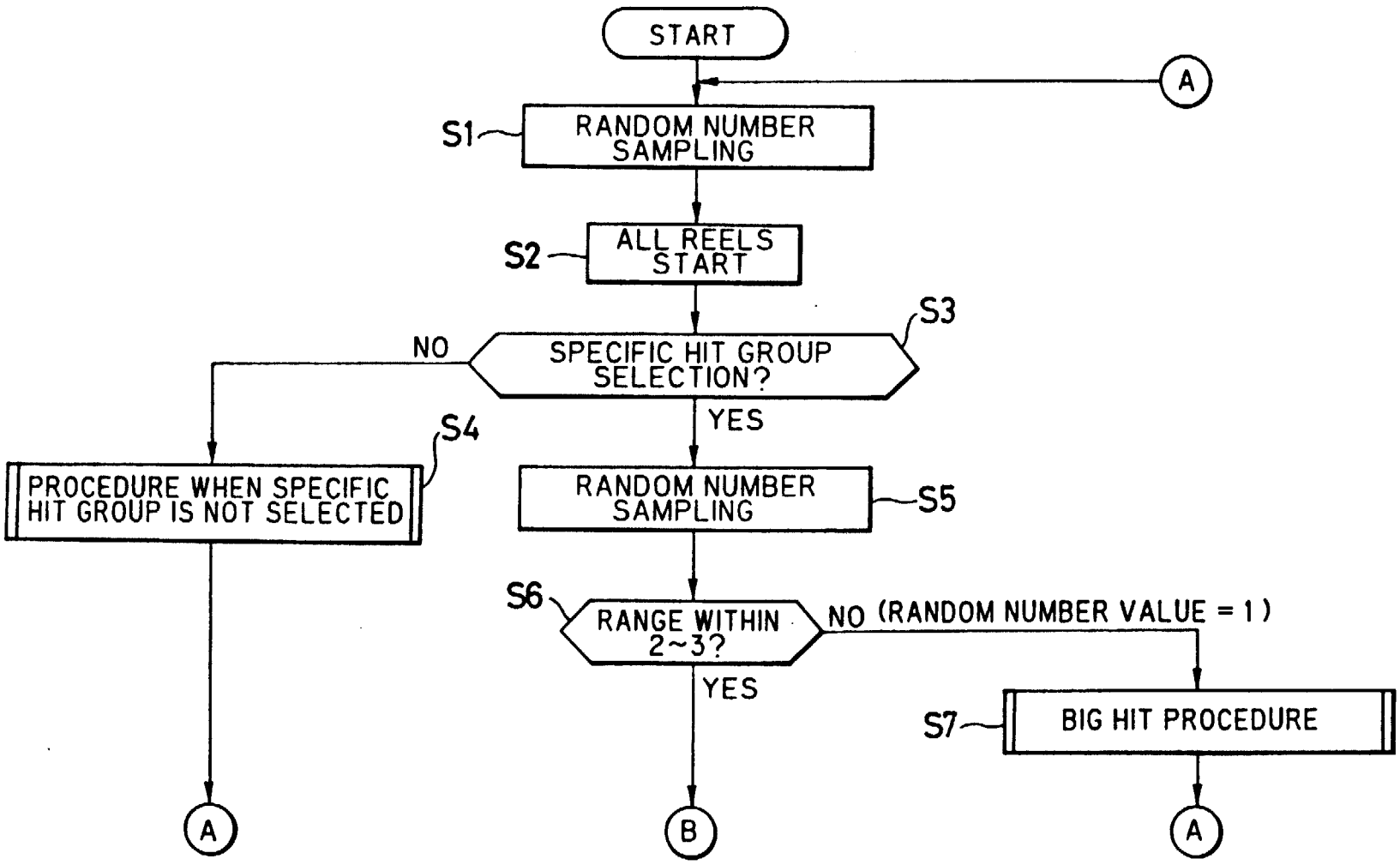
FIGS. 6A and 6B are flow charts showing the steps of playing the game in the present invention.

The operation of the above embodiment will now be described with reference to FIGS. 6A, 6B and 7. To make only the winning line 5c effective, one coin is inserted into the coin insertion slot 7. This coin is detected by the coin sensor 15 and the detection signal is transferred to the counter 16. The signal indicating the number of inserted coins counted by the counter 16 is transferred to the MPU 14 to enable the start of the game. If the start lever 4 is then pulled, the step S1 shown in FIG. 6A is carried out. In this step S1, the first random number generating section 18 generates random numbers within a numerical range from "1" to "100" and samples one optional value. In step S2, the MPU 14 actuates the pulse motors 10a through 10c to cause the respective reels 2a through 2c to rotate simultaneously.

In step S3, in case the first judgment section 23 finds that the sampled random number is "50" with reference to the first judgment data 20, the first judgment section 23 judges that the specific hit group can be selected. Also, if the sampled random number is a value other than 50 within the range from "1" to "100", it is judged that the specific hit group cannot be selected. In the area wherein the specific hit group cannot be selected, the stop positions of the respective reels 2a through 2c are controlled such that symbol combinations other than the specific hits such as a big hit or a middle hit will appear on the effective winning line 5c in step S4. The symbol combinations other than the specific hits include a "small hit" and a "loss". This small hit occurs when, for example, a symbol combination of "CHERRY, CHERRY" appears on two of the three reels. Step S4 having been carried out, the MPU 14 returns to its initial condition for the start of a game, ready for the insertion of a coin for the next game.

If it is judged by the first judgment in step S3 that the specific hit can be selected, then step S5 is next performed. The MPU 14 then causes the second random number generating section 22 to generate random numbers within a range from "1" to "3" and samples one optional value among them. Then, in step S6, the second judging section 24 makes the second judgment with reference to the second judgment data 21. That is, if the sampled random numerical value is "1", it is judged as a "big hit", and if "2" or "3", it is judged as a "middle hit". If it is judged as a "big hit", MPU 14 controls the pulse motors 10*a* through 10*c* to stop in step S7 in such a manner that the hit symbols "7" among a plurality of kinds of symbols shown on the respective reels 2*a* through 2*c* are all aligned on the effective winning line 5*c*, i.e. "777". After the stop control is effected, the appropriate number of coins for a "big hit" is paid out. In this embodiment, a situation wherein the specific hit group can be selected is generated at the probability of "1/100"; and among the hits included n the specific hit group, the middle hit occurs with a probability of "170". This is the same probability as in the conventional case wherein the "middle hit" occurs with a probability of 2/300 by a single probability selection. However, as the probability cycle proceeds in a more uniform way in the present invention, the frequency of the appearance of hits is more average, i.e. more regular.

Next, the operation of the reel stop will be described if it is judged that a "middle hit" has occurred when the random numbers are "2" or "3". In FIG. 7, a1 through a6, b1 through b6 and c1 through c6 schematically show positions wherein the hit symbols "7" on the reels 2*a* through 2*c* are stopped when the judgment is made that there is a "big hit" or a "middle hit". Amount these, a1 through a3 on the first reel, b1 through b3 on the second reel and c1 through c3 on the third reel denote the stopped positions of the symbols on the respective winning lines 5*b* through 5*d* within the window 6. Similarly, a4 through a6 on the first reel, b4 through b6 on the second reel and c4 through c6 on the third reel denote the stopped positions of the symbols which the player cannot see through the display window 6. The respective reels 2*a* through 2*c* are rotated in the direction from a6 toward a1 as shown by arrows in FIG. 7.

Because the relation between the arrangement of the plurality of kinds of symbols and the tongues 11*a* through 11*c* is known, the instantaneous positions of the symbols of "7" on the rotation reels 2*a* to 2*c* can be identified by checking the positions of these tongues. The positions of the tongues 11*a* through 11*c* can be determined by counting the driving pulses from the time the sensors 12*a* through 12*c* detect the passage of the tongues 11*a* through 11*c*. In step S10 of FIG. 6B, the position of this hit symbol "7" is determined. In step S11, MPU 14 judges whether the stop button 3*a* has been depressed or not, and if the button has not been depressed, it keeps determining the current position of the hit symbol "7" of the first reel 2*a*.

When the stop button 3*a* is depressed, whether the hit symbol "7" is passing the position a6 or not is determined in step S12. If the hit symbol "7" is passing the position a6, step S13 is performed, wherein the pulse motor 10*a* is controlled to stop in such a manner that the symbol "7" will be stopped in the position a3. But if symbol "7" is not passing position a6, then step S14 is performed to determine whether symbol "7" is passing position a5. It is to be noted, however, that the detection of the positions of a6, a5, etc. is performed by determining whether hit symbol "7" is present in an area at the center of each symbol shown on each reel that includes a little leeway for detection in the vertical direction from the central point of the symbol. If the hit symbol is passing the position a5, the hit symbol "7" is caused to stop in the position a2 in step S15. But if the symbol "7" is not passing position a5, whether the symbol "7" is passing position a4 or not is detected in step S16. If the symbol "7" is passing the position a4, the symbol "7" shown on the first reel 2*a* is caused to stop in the position A1 in step S17. If it is judged that the symbol "7" is not passing any of the positions a6 through a4 at the time the stop button 3*a* is depressed, then the operation goes back to step S10 and the position of the symbol "7" on the first reel 2*a* is again monitored. Even if the stop button 3*a* is instantaneously depressed at this time, since the time required for the reel 2*a* to make one full rotation is longer than the depressing time, the operation proceeds immediately to step S11. Therefore, even if the stop button 3*a* is instantaneously depressed, it can never happen that the reel 2*a* is not stopped.

The stopping control of the second reel 2*b* is performed in the same way as the control of the stopping of the first reel 2*a*. And in accordance with the stopping control of the second reel 2*b*, the stopping control of the third reel 2*c* is performed. That is, in case the hit symbol "7" of the second reel 2*b* has stopped in one of the positions b3, b2 and b1, the hit symbol "7" of the third reel 2*c* is controlled to stop in a position other than one of the positions c3, c2 and c1. In this way, a middle hit in which two hit symbols "7" are aligned on the winning line occurs and a predetermined number of coins are discharged as a prize for this middle hit.

Also, if a big hit is endorsed by the second judgment, the stop control is performed by the same procedure as the above. A prize-winning symbol combination "777" appears on the effective winning line and a predetermined number of coins is discharged as a prize for it.

Figure 6B:
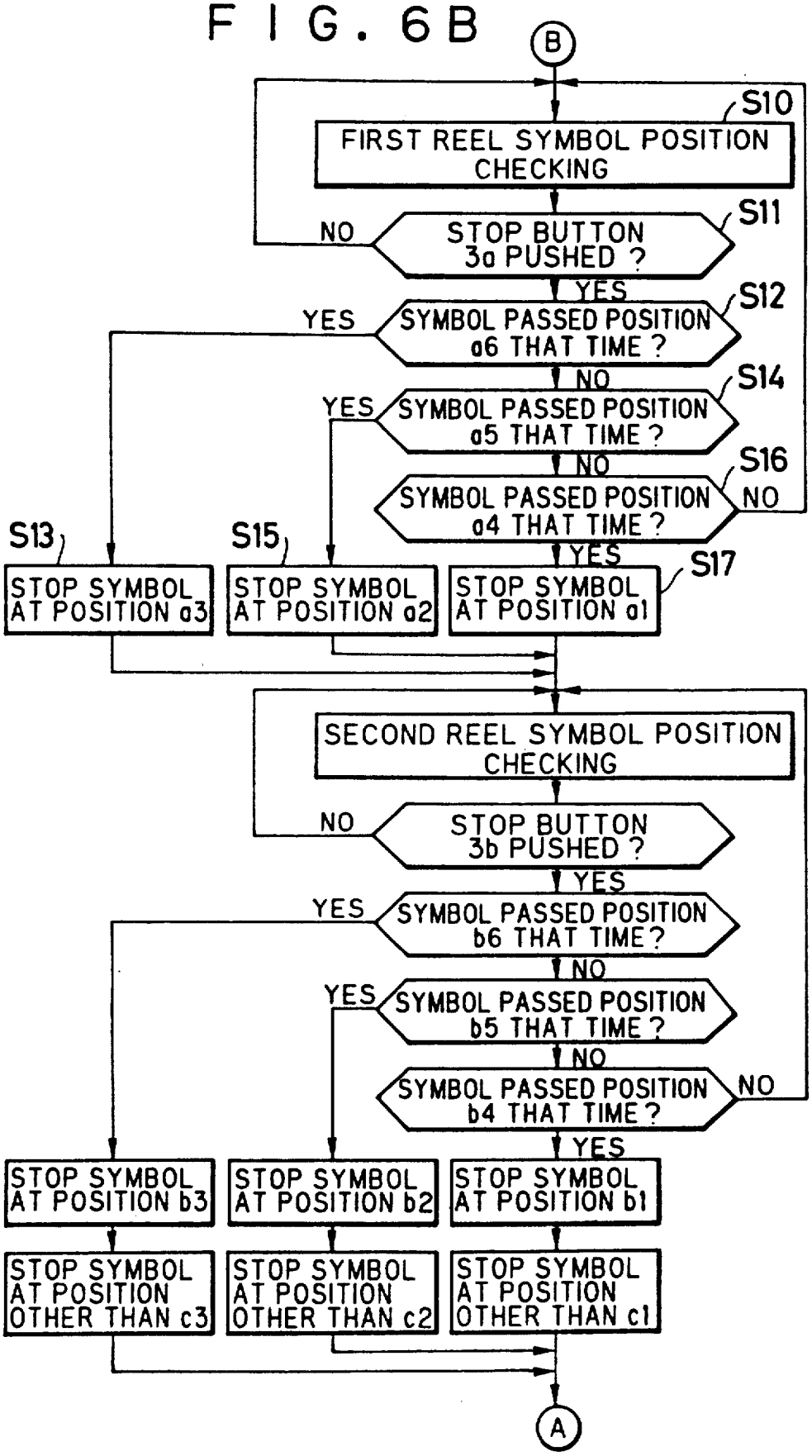
Figure 7:
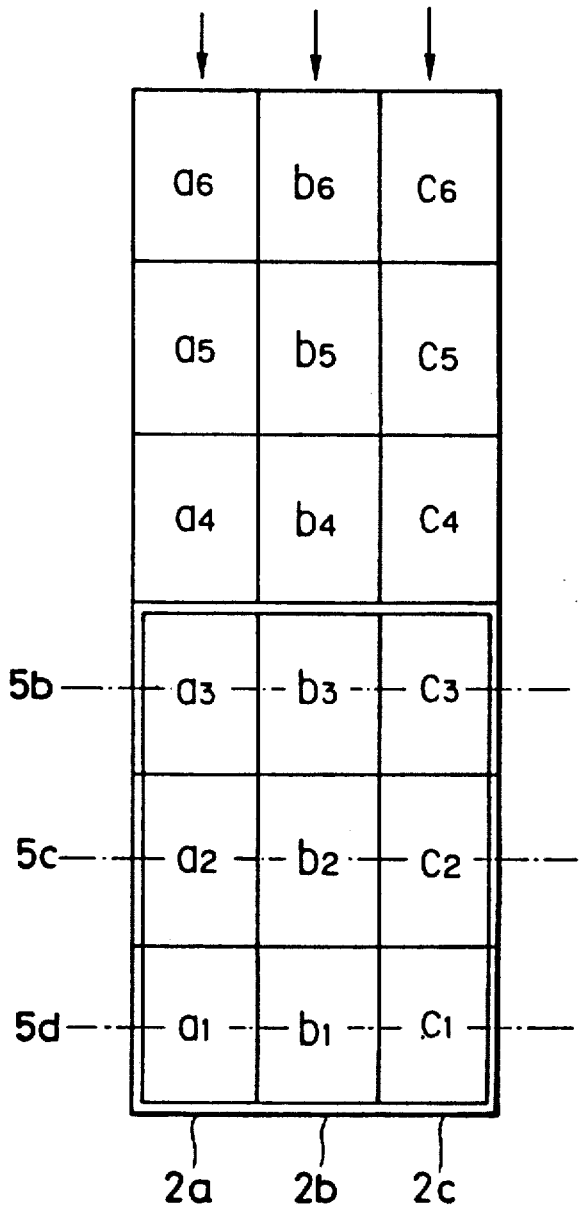
FIG. 7 is an explanatory view showing stopped positions of symbol marks depicted on the respective reels.

In FIG. 6B, it is to be understood that the designation of first to third reels refers to the order in which they are stopped. For example, in FIG. 1, the reel 2*b* can be stopped first by actuating the stop button 3*b*. In this case, the reel 2*b* is the first reel.

In the above-described embodiment, the specific hit group consists of a big hit and a middle hit, and these hits are identified by the number of simultaneous appearances of a common symbol. But if a specific hit is comprised of a combination of different symbols, difficulty is often encountered in producing a predetermined specific hit without an abnormal method of reel stopping, depending on the time of depressing the stop buttons, because one reel may carry a plurality of the symbols that comprise a hit. However, in the described embodiment of the present invention, as a single hit symbol is used and one reel has, say, 4 to 6 hit symbols of this kind, it is easy to accomplish a predetermined prize-winning symbol combination. This enables the stop control of the reels to be effected in accordance with probability.

When two hit symbols "7" are aligned on the winning line, even if the two hit symbols are not adjacent with each other, a middle hit has occurred. In this latter case, the first reel 2*a* and the third reel 2*c* are controlled to display the symbol "7" when stopped. Furthermore, a symbol combination including only one hit symbol "7"

may comprise a small hit and may be included in the specific hit group.

Also, it may be provided that the specific hit group includes a big hit which is the symbol combination "777" and two kinds of specific loss combinations. For this specific loss combination, for example, a symbol combination "7, 7, CHERRY" can be used. If a specific loss combination is included in the specific hit group, the second judgment data may be provided such that the big hit and the specific loss combination will appear with a probability of 1:2. If so, the alignment cf two successive "7"s can give the player the impression that he missed a big hit only at the very last moment, and the player is encouraged to keep playing the game with undiminished enjoyment.

when a hit combination appears, the player is entitled to receive a valuable payment or dividend. In the described embodiment, coins are paid as a dividend: but the dividend may be something else. Examples cf such a reward are the upgrading of the content of a credit counter, or the endorsement of a bonus game or other well known award.

Although two random number generating sections are use din the described embodiment, only one random number generating section can be used in lieu of the two, and two random numbers can be taken therefrom. In this case, the range for generating random numbers is changed in accordance with the kind of judgment.

Although first and second judgments are made in one game, these may partly overlap the preceding or following game. For example, in an Nth game, a judgment is made as a first judgment for an (N+1)th game, and by the first judgment in the (N+1)th game, a second judgment for this game is made. The kind of the specific hit is determined by this second judgment, and the stopped positions of the reels are controlled in such a manner as to accomplish this; then the second judgment in the (N+1)th game is used as the first judgment for the (N+2)th game.

Furthermore, the present invention may be applied to a video-type slot machine in which images of reels are displayed on a CRT through video signals. The term "reels" as used herein is intended also to cover such CRT displays.

Moreover, the stop buttons may be omitted so that the reels may be automatically stopped one after another. In this case, when a predetermined time has passed, the reel stop operation is started by a timer.

In these and other ways the present invention can be changed and modified without departing from the spirit and scope of the invention as set forth in the appended claims.

What is claimed is:

1. A slot machine having a plurality of reels for sequentially displaying a plurality of series each comprised by a plurality of symbols, said slot machine comprising:

random number generator means for generating a first random number and a second random number;

memory means for storing first judgment data and second judgment data, said first judgment data indicating a relation between said first random number and a group comprises of a plurality of predetermined combinations of symbols, said second judgment data indicating a relation between said second random number and a particular symbol combination included in said group;

judgment means for making a first judgment to determine said relation of said first random number by reference to said first judgment data, thereby to determine whether any combination from said group is to be displayed, and a second judgment to determine said relation of said second random number by reference to said second judgment data, thereby to determine which one of said combinations of said group is to be displayed; and control means for controlling the stopped position of each of said reels such that said one of said combinations determined by said first and second judgments is displayed.

2. A slot machine as claimed in claim 1, wherein said group of symbol combinations includes a plurality of prize-winning symbol combinations.

3. A slot machine as claimed in claim 2, wherein at least some of the symbols of said prize-winning combinations are hit symbols, and the value of each said prize-winning symbol combination varies as the number of hit symbols in said combination.

4. A slot machine as claimed in claim 3, wherein said hit symbols are each a numeral "7".

5. A slot machine as claimed in claim 4, wherein said group of symbol combinations includes a big hit symbol combination consisting only of symbols "7" and a plurality of loss symbol combinations which include a said symbol "7".

6. A slot machine as claimed in claim 1, wherein said first judgment is performed first and, in case the result of said first judgment has revealed that said selection of said group can be made, said second judgment is performed.

7. A slot machine as claimed in claim 1, wherein said second judgment is performed first to decide on one of said symbol combinations included in said group, and thereafter said first judgment is performed and, in case the result of said first judgment has revealed that said group can be selected, said symbol combination decided on by said second judgment is displayed.

8. A slot machine as claimed in claim 1, wherein said first random number is an integer in the numerical range from "1" to "100".

9. A slot machine as claimed in claim 1, wherein said plurality of reels are at least three in number.

10. A slot machine as claimed in claim 1, which further includes a plurality of stop buttons each corresponding to a respective one of said reels, and wherein the actuation of each said stop button selectively actuates the stopping of the corresponding reel.

11. A slot machine having a plurality of reels for sequentially displaying a plurality of series each comprises by a plurality of symbols, said slot machine comprising:

random number generator means for generating random numbers;

memory means for storing first judgment data and second judgment data, said first judgment data indicating a relation between a random number which is taken from said random number generator means by a first trial and a group comprises by a plurality of predetermined combinations of symbols, thereby to determine whether any combination within said group can be displayed, said second judgment data indicating a relation between a random number which is taken from said random generator means by a second trial and particular combination, corresponding to the last-named random number, from said group which is to be displayed;

judgment means for making a first judgment using said first judgment data to determine whether any combination of said group can be displayed and for making a second judgment using said second judgment data in order to select a specific combination from said group if said first judgment has determined that a said combination from said group can be displayed; and control means for controlling the stopped position of each of said reels such that said reels display said specific symbol combination.

12. A slot machine as claimed in claim 11, wherein said group of combinations includes a plurality of prize-winning combinations.

13. A slot machine as claimed in claim 11, wherein said plurality of prize-winning combinations include a middle hit in which two hit symbols "7" are aligned and a big hit in which three hit symbols "7" are aligned.

* * * * *